US005927551A

United States Patent [19]

Taylor et al.

[11] Patent Number: 5,927,551

[45] Date of Patent: Jul. 27, 1999

[54] POWER ASSEMBLY APPARATUS

[75] Inventors: Todd A. Taylor, Oxford, N.J.; Jeffrey Peck, Finksberg, Md.

[73] Assignee: Exxel Container, Inc., Somerset, N.J.

[21] Appl. No.: 08/742,347

[22] Filed: Nov. 1, 1996

[51] Int. Cl.[6] ..... B65D 35/28

[52] U.S. Cl. ..... 222/95; 222/105; 222/386.5

[58] Field of Search ..... 222/95, 105, 183, 222/386.5, 402.1

[56] References Cited

U.S. PATENT DOCUMENTS

| | | | |
|---|---|---|---|
| 4,387,833 | 6/1983 | Venus | 222/95 |
| 4,964,540 | 10/1990 | Katz | 222/95 |
| 5,111,971 | 5/1992 | Winer | 222/95 |
| 5,127,554 | 7/1992 | Loychuk | 222/386.5 |
| 5,143,260 | 9/1992 | Loychuk | 222/386.5 |

FOREIGN PATENT DOCUMENTS

| | | | |
|---|---|---|---|
| 63-294378 | 12/1988 | Japan | 222/95 |

*Primary Examiner*—Joseph A. Kaufman
*Attorney, Agent, or Firm*—Cooper & Dunham LLP

[57] ABSTRACT

An improved fluid dispensing article is disclosed. The dispenser has a flexible, pleated and coated bag, securely seated within an enclosure. An improved inner container is provided with a seating member that substantially prevents movement within the enclosure.

7 Claims, 3 Drawing Sheets

POWER ASSEMBLY APPARATUS

FIELD OF THE INVENTION

This invention relates to a fluid dispenser which contains and dispenses a fluid under pressure. More particularly, this invention relates to an improved fluid dispenser which uses an elastomeric sleeve, rather than an aerosol gas to expel the fluid through a valve mechanism.

BACKGROUND OF THE INVENTION

Flexible fluid dispensers which collapse when the fluid is expelled have various uses. Recently, interest in these types of dispensers has increased because they provide a relatively inexpensive alternative to aerosol dispensers which use fluorocarbon or other gas as a propellant, and which have become environmentally undesirable.

In this non-aerosol dispenser, the flexible container is disposed within an expandable container. A rubber sleeve surrounds the casing to apply continuous pressure on the container walls and the fluid therein. A valve on the mouth of the container permits fluid to be dispensed as desired. The expelling force is provided by an elastomeric sleeve which surrounds the flexible fluid container and provides the expelling force when stretched to an open position.

U.S. Pat. No. 4,387,833, issued Jun. 14, 1983, incorporated herein by reference, discloses a dispenser having an extra sleeve to keep the rubber sleeve from slipping in the axial direction. This dispenser comprises an inner container having a ringed, outwardly-extending flange, smaller in diameter than the diameter of the valve assembly, which snapped into an inwardly-extending flange on the inside of the outer container's neck, thereby seating the valve assembly within the outer container's neck. The molding of the inner neck area of the outer container, however, may be very difficult and not economically feasible to manufacture.

U.S. Pat. No. 4,964,540, assigned to the assignee of the present application, also incorporated herein by reference, discloses a dispenser with means for collapsing, in a controlled manner, the flexible container which is enclosed in a rigid enclosure. Specifically, a dispenser is disclosed comprising a tubular, pleated container which has been coated with an elastomeric material such as latex and has a plurality of longitudinal ribs in the valleys of the pleats. These ribs enhance the controlled folding of the pleats in the container, until substantially all the fluid disposed within the bag has been expelled. The container has a mouth at one end, to which is secured to a valve. The mouth also helps seat the container within the enclosure. This seating mechanism tends to be difficult to control dimensionally during manufacture due to variations in container neck and associated structures. If these tolerances are too great or too small, the snap ring will not properly engage the outer container.

Further, the device also seems to require a thicker plastic lip in the mouth area, which can create difficulties in molding. Variations in cooling tend to cause dimensional variations in the molded product. Since the crimped valve is clamped to the mouth of the enclosure, variations in dimension of the mouth compound the problem of unstable sealing of the valve assembly to the mouth of the container which will result in a faulty seal or a leaky dispenser.

SUMMARY OF INVENTION

It is therefore an object of the present invention to provide an improved apparatus for dispensing fluid, which securely seats within a conventional or easily produced, rigid enclosure. The present invention provides an apparatus for containing and dispensing a fluid under pressure comprising: an enclosure having a mouth and a lip; an elongated, flexible container inserted within the enclosure. The container has a neck defining an opening, a seating member adjacent the neck, and a pleated fluid containing portion. The seating member secures the container within the enclosure and includes upper and lower surfaces. A valve for passage of fluid under pressure covers the opening of the container. The dispenser also includes expandable energy tube which substantially surrounds the container for maintaining pressure on the container and its contents, and a retaining ring having first and second spaced annular bosses on the interior thereof for capturing the seating member of the container and the lip of the enclosure in rigid alignment, thereby fixedly positioning the container within the enclosure.

DESCRIPTION OF THE PREFERRED EMBODIMENTS

Figure 1:
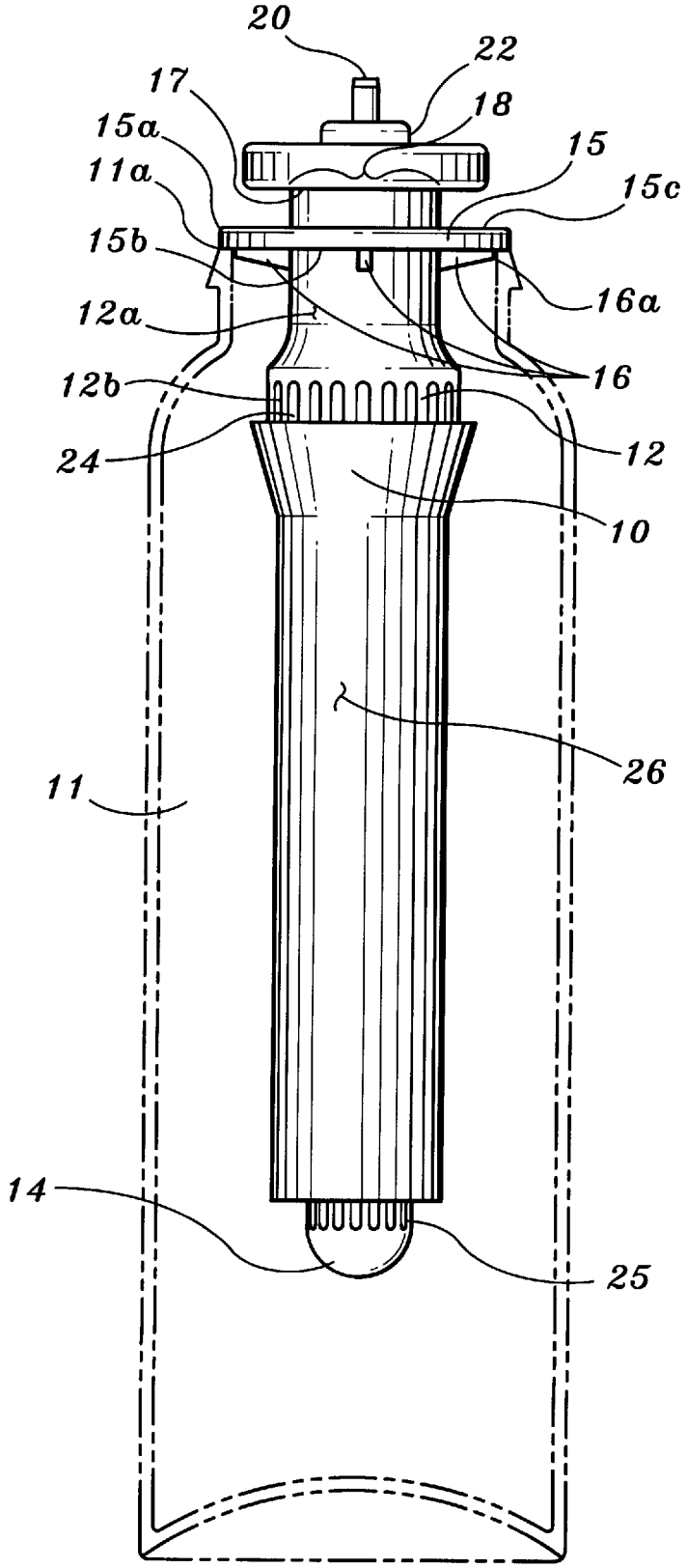
FIG. 1 illustrates an embodiment of the apparatus of the present invention.

Referring now to FIG. 1, a dispenser for containing and dispensing a pressurized fluid is generally depicted by reference numeral 10. The dispenser 10 includes an enclosure 11 (shown in phantom) and a container 12 inserted therein. The container 12 is flexible, elongated cylindrical receptacle with a closed bottom end 14, and includes the improved seating mechanism of the present invention 15 for stably seating the container 12 within the enclosure 11.

Figure 2:
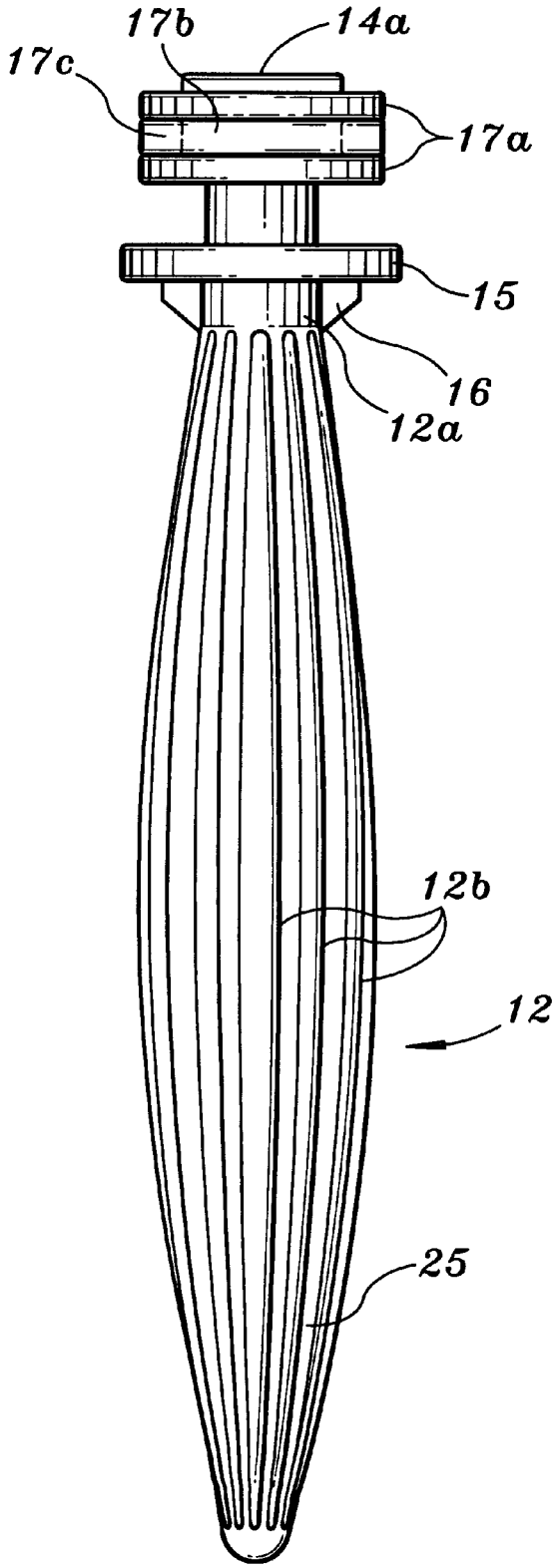
FIG. 2 shows the pleated enclosure for use in the apparatus of FIG. 1; for use in the apparatus of the present invention.

The container 12 also includes a neck 12*a* and a plurality of pleats 12*b*, as shown in FIG. 2. Above the neck 12*a* is a mouth 14*a* through which fluid under pressure can enter and exit. The container 12 is preferably dipped in a latex emulsion after pleating to put a resilient coating 25 on the pleats 12*b* to help them refold in a desired orientation. The coated container 12 is disposed within an elastomeric sleeve 26 (FIG. 1), such as a rubber energy tube, which extends from below the neck 12*a* of the container 12 to its bottom end 14*b*.

Figure 3:
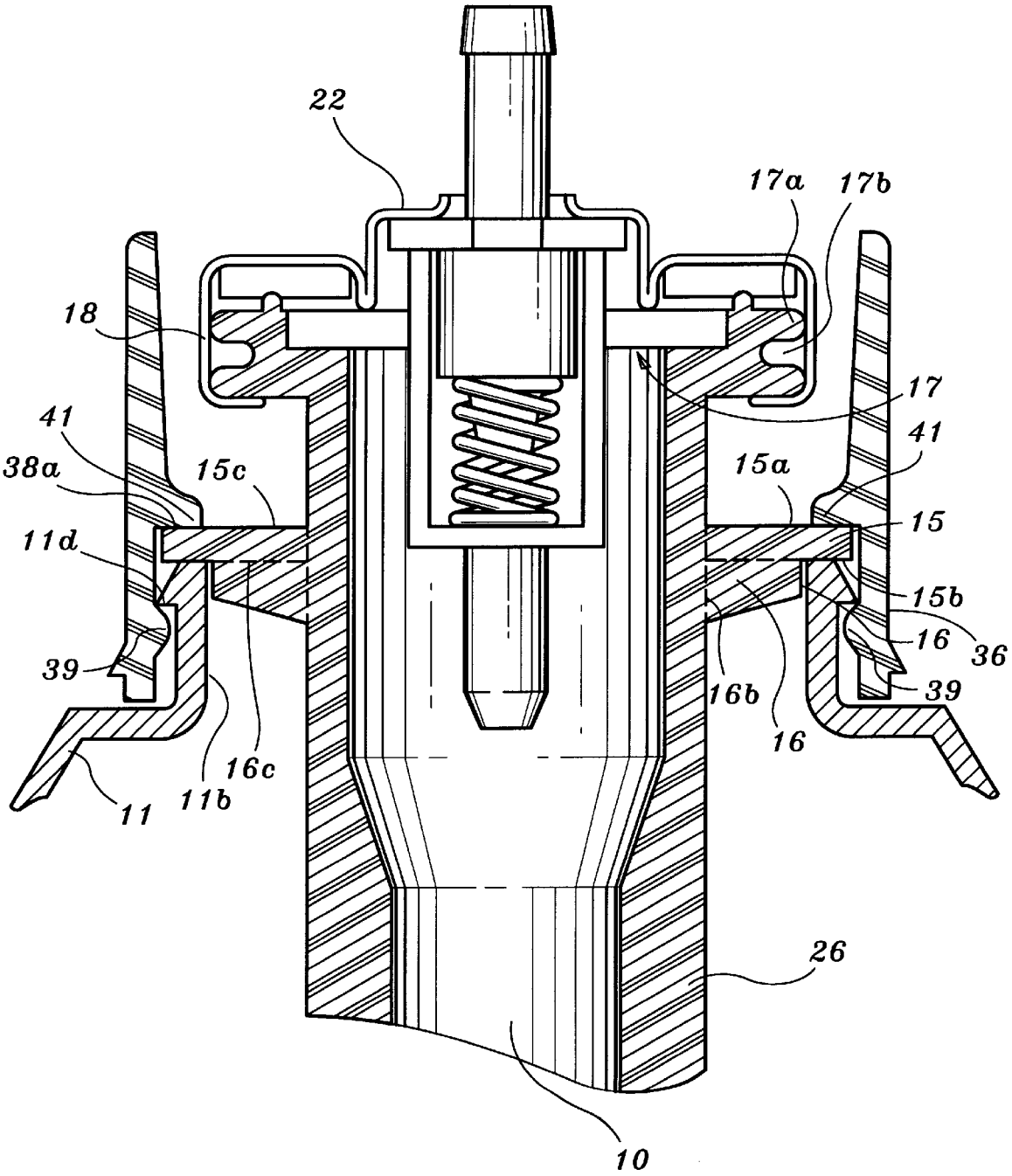
FIG. 3 is an enlarged partial sectional view of the apparatus of the present invention.

Referring now to FIGS. 1 and 3, the improved seating member 15 of the present invention includes an outwardly extending annular ring 15*a* adjacent the neck 12*a* and sized to overlap the top edge 11*a* of a desired enclosure 11. The annular ring 15*a* has a bottom surface 15*b* and a top surface 15*c*. The bottom surface 15*b* of the seating member 15 rests on the top edge 11*a* of the enclosure 11, thereby seating the container 12 within the enclosure 11. Because both the bottom surface 15*b* of the seating member 15 and the top edge 11*a* of the enclosure 11 are flat, they overlap along the entire circumference of the annular ring 15*a*. Further, the improved seating member 15 of the container 12 is adaptable to a relatively conventional, rigid enclosure 11.

Referring now to FIGS. 1 and 3, a plurality of support ribs 16 center the container in the mouth of the enclosure 11. Each support 16 has a preferably trapezoidal shape, as best shown in FIG. 2. The support ribs 16 provide support for the seating mechanism 15, and help to center the container 12 inside the enclosure 11. An outer edge 16*a* of the rib 16 abuts the mouth 11*c* of the enclosure 11, while another edge 16*c* abuts the annular ring 15*b* of the seating member 15. The size of the ribs 16 can be varied so as to accommodate different sizes of containers assemblies 12 and enclosures 11.

The improved dispenser 10 also has an improved seating mechanism 17 for the dispensing valve 22. The seating mechanism 17 includes a pair of rings 17*a* with a groove 17*b* defined therebetween. The rings 17*a* are reinforced by a plurality of spacers 17*c* which extend longitudinally to join the rings 17*a* to reinforce them. This arrangement permits the use of two thinner rings 17*a* rather than a single thick ring (not shown), which allows the rings 17*a* to cool faster while keeping the lower portion of the bottle container 12 hot, soft and pliable, so that it can be stretched and blown during the remainder of the molding process.

Referring now to FIG. 3, to secure the container 12 within the enclosure 11, the container 12 is first inserted into retaining ring 36 so that it is captured between the first 39 and second 41 annular bosses located on the interior of the retaining ring 36. The container 12 is then inserted into enclosure 11 so that the lip 11*d* of the enclosure 11 is also captured in the space between the first 39 and second 41 annular bosses on the interior of the retaining ring 36. As seen in FIG. 3, the lip 11*d* of the enclosure 11 and the seating member 15 of the container 12 are held between the first and second spaced annular bosses 39, 41 on the retaining ring 36 in stationary adjacent alignment, thereby fixedly positioning the container within the enclosure.

A metal valve ferrule 18 having a central opening 20 is used to fasten the valve assembly 22 to the container 12. The ferrule 18 has a central orifice 20 communicating with the interior of the ferrule 18. The valve assembly 22 is held in place and a seal is created separating the inner chamber of the container 12 from the ambient environment. The container 12 may accept standard, pre-assembled valve, with or without an actuator or may use a specially designed valve. Such a valve is described in the co-assigned above-mentioned U.S Pat. No. 4,387,833. After the container 12 is inserted in the enclosure 11, an actuator (not shown) is mounted on top of the valve 22.

Referring now to FIGS. 1 and 3, vacuum is applied to the mouth 14 of the container 12 prior to its insertion into the elastomeric member 26. This process draws the pleats 24 very close together to ease the insertion process.

The inner diameter of the elastic member 26 is smaller (by about 35%) than the outer diameter of the coated container 12. The value assembly 22 is fitted over the open end of the container 12 and the ferule 18 is crimped in place to form an air and fluid tight seal.

To fill the assembled container, a fluid is fed under pressure through the valve 22 into the container 12 forcing it to expand substantially to accept the volume of fluid. Member 26 also expands creating potential energy to expel the fluid. With the valve 22 closed, the elastomeric member 26 applies sufficient force on the container 12 to keep it pressurized after it has been disconnected from the pressurized fluid source. Thus the fluid may be dispensed by depressing the valve assembly 22 to allow passage of the fluid through the valve 22 to the extension of the container 12.

Various modifications and improvements will occur to those skilled in the art. All such modifications and improvements are intended to be within the scope of the invention as defined by the following claims.

What is claimed is:

1. An apparatus for containing and dispensing a fluid under pressure, comprising;

an enclosure having a mouth and a lip;

an elongated, flexible container inserted within the enclosure, the container having a neck defining an opening, a pleated fluid containing portion, and a seating member adjacent the neck for securing the container within the enclosure, the seating member including upper and lower surfaces spaced apart by a plurality of support members;

a valve for passage of fluid under pressure;

an expandable energy tube substantially surrounding the container for maintaining pressure on the container and its contents; and a retaining ring having first and second spaced annular bosses on the interior thereof for capturing the seating member of the container and lip of the enclosure in stationary adjacent alignment, thereby fixedly positioning the container with the enclosure.

2. An apparatus in accordance with claim 1 further comprising a plurality of supports beneath the seating member.

3. An apparatus in accordance with claim 1 wherein a portion of the bottom surface of the seating member rests on the lip of the enclosure.

4. An apparatus in accordance with claim 2, wherein the plurality of supports extend outwardly from the neck of the container and are sized for a snug fit in the mouth of the enclosure when the container is within the enclosure to center the container in the enclosure.

5. An apparatus in accordance with claim 1 wherein the seating member on the container comprises first and second rings extending from the neck of the container.

6. An apparatus for containing and dispensing a fluid under pressure, comprising:

an enclosure having a mouth and a lip;

an elongated, flexible container inserted within the enclosure, the container having a neck defining an opening, a pleated fluid containing portion, and a seating member for securing the container within the enclosure, the seating member having first and second rings extending from the neck of the container and a plurality of vertical supports extending between the first and second rings;

a valve for passage of fluid under pressure;

an expandable energy tube substantially surrounding the container for maintaining pressure on the container and its contents; and a retaining ring having first and second spaced annular bosses on the interior thereof for capturing the seating member of the container and the lip of the enclosure in stationary adjacent alignment, thereby fixedly positioning the container within the enclosure.

7. An apparatus in accordance with claim 6, wherein the plurality of supports are vertical.

* * * * *